US006390000B1

(12) United States Patent
Nishikawa

(10) Patent No.: US 6,390,000 B1
(45) Date of Patent: May 21, 2002

(54) DOUBLE CHAINSTITCH SEWING MACHINE

(75) Inventor: Masahiko Nishikawa, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/923,055

(22) Filed: Aug. 6, 2001

(30) Foreign Application Priority Data

Aug. 28, 2000 (JP) ..... 2000-256883

(51) Int. Cl.[7] ..... D05B 1/10; D05B 49/00

(52) U.S. Cl. ..... 112/165; 112/249

(58) Field of Search ..... 112/165, 166, 112/197, 199, 241, 248, 249

(56) References Cited

U.S. PATENT DOCUMENTS 5,732,640 A * 3/1998 Mizusaki et al. ..... 112/248
5,816,175 A * 10/1998 Teramoto ..... 112/165

FOREIGN PATENT DOCUMENTS

JP 63-26144 7/1988

* cited by examiner

*Primary Examiner*—Peter Nerbun
(74) *Attorney, Agent, or Firm*—Flynn, Thiel, Boutell & Tanis, P.C.

(57) ABSTRACT

In a double chainstitch sewing machine, a movable thread guide 37 is fixed to the lower end of a needle bar 1. A fixed thread guide 41 and a thread take-up cam 39 are fixed to a jaw 43*a* of a sewing machine arm 43. The thread take-up cam 39 has a cam section to be engaged with needle threads 51*a*, 51*b* from the fixed thread guide 41 to the movable thread guide 37, and takes up the needle threads oscillating up and down by vertical motion of the movable thread guide 37. Thread take-up members such as movable thread guide 37, fixed thread guide 41, and thread take-up cam 39 are disposed centrally at the lower end of the needle bar near the needle and in the jaw 43*a* of the sewing machine arm 43. As a result, there is no member for thread take-up moving at the upper side and front side of the sewing machine arm, and dangerous positions for the operator can be decreased. Further, the thread pathway length from the workpiece to the thread tension device is shortened, and the effects of thread stretch properties can be decreased.

7 Claims, 10 Drawing Sheets

DOUBLE CHAINSTITCH SEWING MACHINE

The present invention relates to a double chainstitch sewing machine for forming stitches for applying a cover thread at the lower side or upper and lower sides of a workpiece.

BACKGROUND OF THE INVENTION

FIG. 11 shows a double chainstitch sewing machine for forming stitches related to stitch type number 407 and others designated in the United States Federal Standards No. 751a.

In this sewing machine, the needle thread is first passed from a thread tension device 117 into a thread eye of a first thread take-up 116 through a fixed thread guide 114. In succession, the needle thread is passed into a thread eye of a movable thread guide 115 through a U-shaped second thread take-up 118, and is passed into an eyelet of a needle holder 120 at the lower end of a needle bar 112 and an eyelet of a needle 119.

When forming stitches for applying a cover thread at the upper and lower sides of a workpiece by this double chainstitch sewing machine, an upper cover thread mechanism disclosed in Japanese Utility Model 63-26144 is disposed beneath a sewing machine head 111*a*. The upper cover thread is supplied into the upper cover thread mechanism by way of a thread take-up for upper cover thread (not shown) provided in the first thread take-up 116 from the thread tension device 117.

The movable thread guide 115 is affixed to the upper end of the needle bar 112, and moves up and down together with the needle bar. The first thread take-up 116 is affixed to an oscillating shaft 113, and oscillates about the shaft. All these members move up and down or oscillate outside of the sewing machine arm 111 and are hence dangerous. Accordingly, to protect the operator from danger, a guard is required, but such guard makes it difficult to pass the thread. If the guard is designed to be opened and closed for the ease of passing of thread, it leads to a cost increase.

Further, in this sewing machine, there is a probability of oil leak from the support parts of the needle bar projecting from the top of the sewing machine arm, and the oscillating shaft projecting to the front side of the sewing machine arm.

In such double chainstitch sewing machine, the needle thread from the thread tension device to the workpiece runs for a long thread pathway extending from the thread tension device to the workpiece by way of the fixed thread guide, first thread take-up, second thread take-up and movable thread guide. Accordingly, it is likely to have effects of stretchable characteristic of thread, and it is hard to obtain an optimum thread take-up amount.

Especially in largely stretchable thread such as woolly thread, the movable thread guide, first thread take-up and second thread take-up act more to stretch thread than to take up thread, so that the take-up action is unstable. It is hard to adjust by the first and second thread take-up amounts and is hence difficult to obtain a double chainstitch of a desired touch. Still more, since the upper cover thread is taken up at the same timing as the needle thread, it is hard to obtain a desired covering chainstitch.

It is hence an object of the present invention to eliminate the difficulty in threading without substantially increasing the cost, by eliminating movable thread take-up members on the upper side and front side of the sewing machine arm, and installing substituent movable thread guide and first and second thread take-ups centrally at the lower end of the needle bar or jaw of the sewing machine arm so as to decrease the dangerous positions for the operator. It is other object of the present invention to avoid the probability of oil leak from the support parts of the needle bar projecting from the top of the sewing machine arm, and the oscillating shaft projecting to the front side of the sewing machine arm.

It is a further object of the present invention to present a double chainstitch sewing machine capable of obtaining a desired stitch tension easily by shortening the thread pathway length from the workpiece to the thread tension device and decreasing effects of thread stretchable characteristic on take-up of needle thread, and a double chainstitch sewing machine related to a flat seam for taking up upper cover thread at optimum timing by installing a thread take-up for upper cover thread independently of a thread take-up for the needle thread.

SUMMARY OF THE INVENTION

In a first aspect of the double chainstitch sewing machine according to the present invention, a movable thread guide for guiding the needle thread is fixed to the lower end of the needle bar. A fixed thread guide is fixed to the jaw of the sewing machine arm. A thread take-up cam is also fixed to the jaw of the sewing machine arm, and the cam section of the thread take-up cam extends in the vertical direction by intersecting with the needle thread pathway between the fixed thread guide and the movable thread guide. The needle thread from the fixed thread guide to the movable thread guide is oscillated up and down from the fixed thread guide by the movable thread guide moving up and down together with the needle bar, and is supplied into the cam section of the thread take-up cam. Thus, by interaction of the movable thread guide and the cam section of the thread take-up cam, the needle thread is taken up from the thread tension device to the needle.

In a second aspect of the double chainstitch sewing machine according to the present invention, a movable thread guide for guiding the needle thread is fixed to the lower end of the needle bar, and a fixed thread guide having mutually opposite right and left thread eyes is fixed to the jaw of the sewing machine arm. A thread take-up cam is also fixed to the lower end of the needle bar, and the cam section of the thread take-up cam is disposed between the thread eyes of the fixed thread guide. The needle thread from the fixed thread guide to the movable thread guide is oscillated up and down from the fixed thread guide by the movable thread guide moving up and down together with the needle bar, and the needle thread between the thread eyes of the fixed thread guide is bent by the vertical motion of the cam section of said thread take-up. Thus, by interaction of the movable thread guide and the thread take-up cam, the needle thread is taken up from the thread tension device to the needle.

According to these aspects of the present invention, since the thread take-up oscillating vertically at the front side of the sewing machine arm and the movable thread guide moving vertically as being affixed to the upper end of the needle bar are eliminated, the operator is liberated from the danger during operation of the sewing machine at the front side and upper side of the sewing machine arm. At the same time, the support parts of the needle bar projecting from the top of the sewing machine arm, and the oscillating shaft projecting to the front side of the sewing machine arm in the conventional sewing machine can be eliminated, and probability of oil leak is avoidable. Further, the movable thread guide of the thread take-up mechanism is attached to the lower end of the needle bar, the fixed thread guide is fixed and installed at the jaw of the sewing machine arm, and the thread take-up cam is attached to the lower end of the needle bar or fixed and installed at the jaw of the sewing machine arm, so that the thread take-up action of the needle thread takes place near the needle, and the thread pathway length from the workpiece to the thread tension device can be shortened, and the thread take-up action of the needle thread is done without substantially having effects of the stretchable characteristic of the thread.

In a third aspect, relating to a double chainstitch sewing machine having a plurality of needles, two or more thread eyes are provided in the movable thread guide, and are disposed obliquely to the motion direction of needle bar.

In a fourth aspect, relating to a double chainstitch sewing machine having a plurality of needles, two or more thread eyes are provided in the movable thread guide, the fixed thread guide is composed of a plurality of thread guide members, and each thread guide member can adjust the guiding position of the needle thread individually.

In the double chainstitch sewing machine having a plurality of needles, the eye of each needle is different in height in order to match the timing with the eyelet of the looper, and the needles are arranged obliquely. In the present invention, since the thread eyes of the movable thread guide are arranged obliquely, or the thread guide members of the fixed thread guide can be adjusted individually, the thread take-up amount necessary for each needle thread can be assured.

In a fifth aspect of the double chainstitch sewing machine according to the present invention, the thread tension device for adjusting the tension of the upper cover thread is provided at the front side of the sewing machine arm, and an upper cover thread mechanism having a spreader for swinging the upper cover thread laterally to be engaged with the needle thread is provided at the jaw of the sewing machine arm, said upper cover thread mechanism is comprised a fixed thread guide for guiding the upper cover thread and a thread swing guide. The thread swing guide has a thread eye for leading the upper cover thread from the fixed thread guide to a thread lead tool, and a slot for leading the upper cover thread from the thread lead tool to the spreader. The spreader includes a thread take-up tool for taking up the upper cover thread by engaging with the upper cover thread from the fixed thread guide to the thread swing guide.

According to the present-invention, since the thread take-up tool for the upper cover thread is attached to the spreader, the motion of the thread take-up tool is synchronized with the motion of the spreader, and the upper cover thread is taken up independently of the thread take-up tool of the needle thread.

In a sixth aspect, since the upper end of the needle bar is positioned within the sewing machine frame and the length of the needle bar is shortened, it is able to reduce the weight of the needle bar and to increase the sewing machine speed.

In a seventh aspect, the needle bar drive mechanism comprises an oscillating shaft crossing orthogonally with the upper shaft and oscillating in cooperation with the rotation of the upper shaft, and a lever fixed to the oscillating shaft for driving the needle bar as being coupled to the upper end of the needle bar.

Other features and effects of the present invention will be more clearly understood in the following detailed description of the embodiments by those skilled in the art. It must be, however, noted that the technical scope of the present invention is not limited to the embodiments and the accompanying drawings alone.

DETAILED DESCRIPTION OF THE PREFERRED EMBODIMENTS

A double chainstitch sewing machine in a first embodiment of the present invention comprises a needle bar mechanism, a looper mechanism, a sewing thread take-up mechanism, and is designed to form stitches of stitch type number 406 designated in the United States Federal Standard No. 751a.

Each mechanism is sequentially described below.

Needle Bar Mechanism

Figure 2:
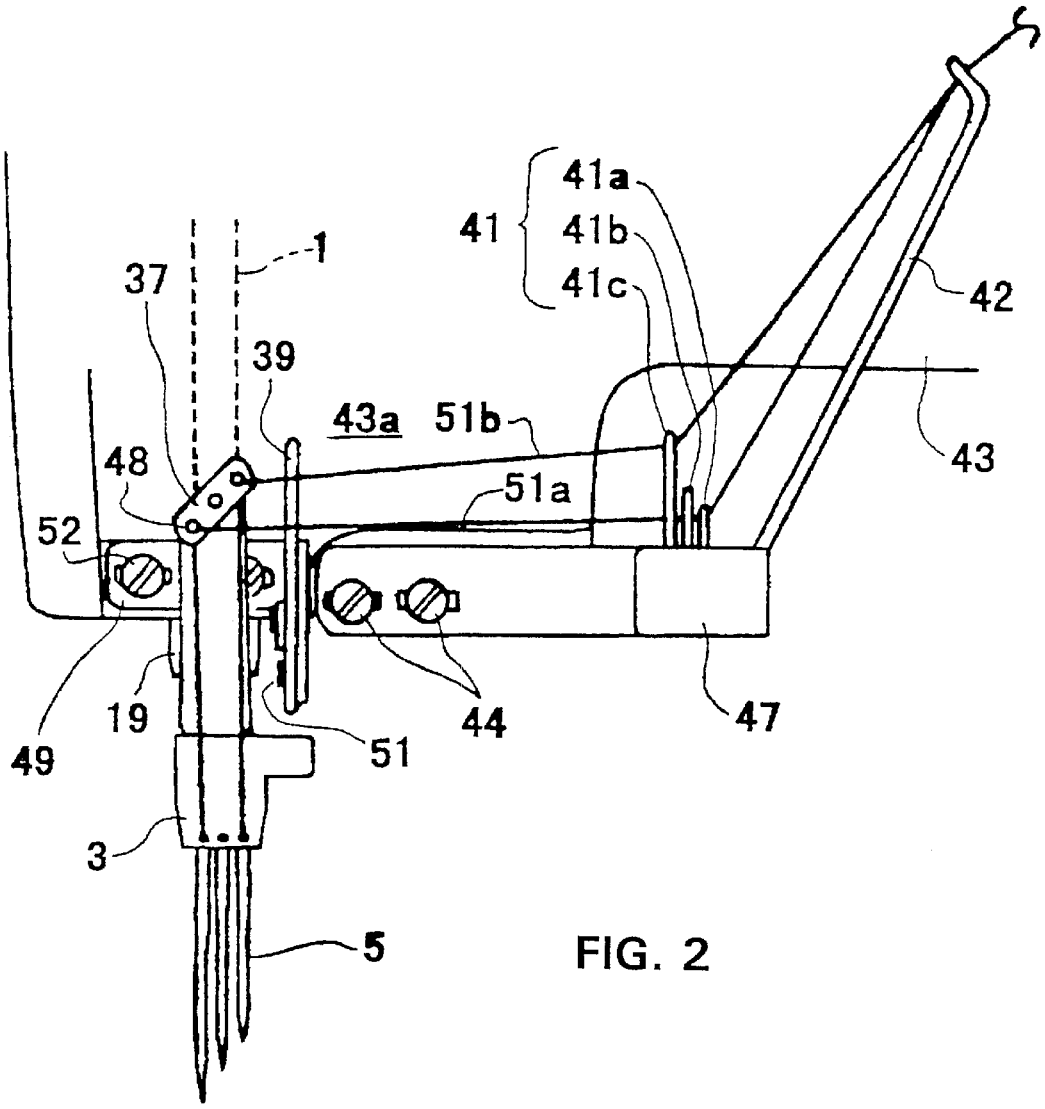
FIG. 2 is a magnified front view of the jaw of the sewing machine in FIG. 1.
Figure 5:
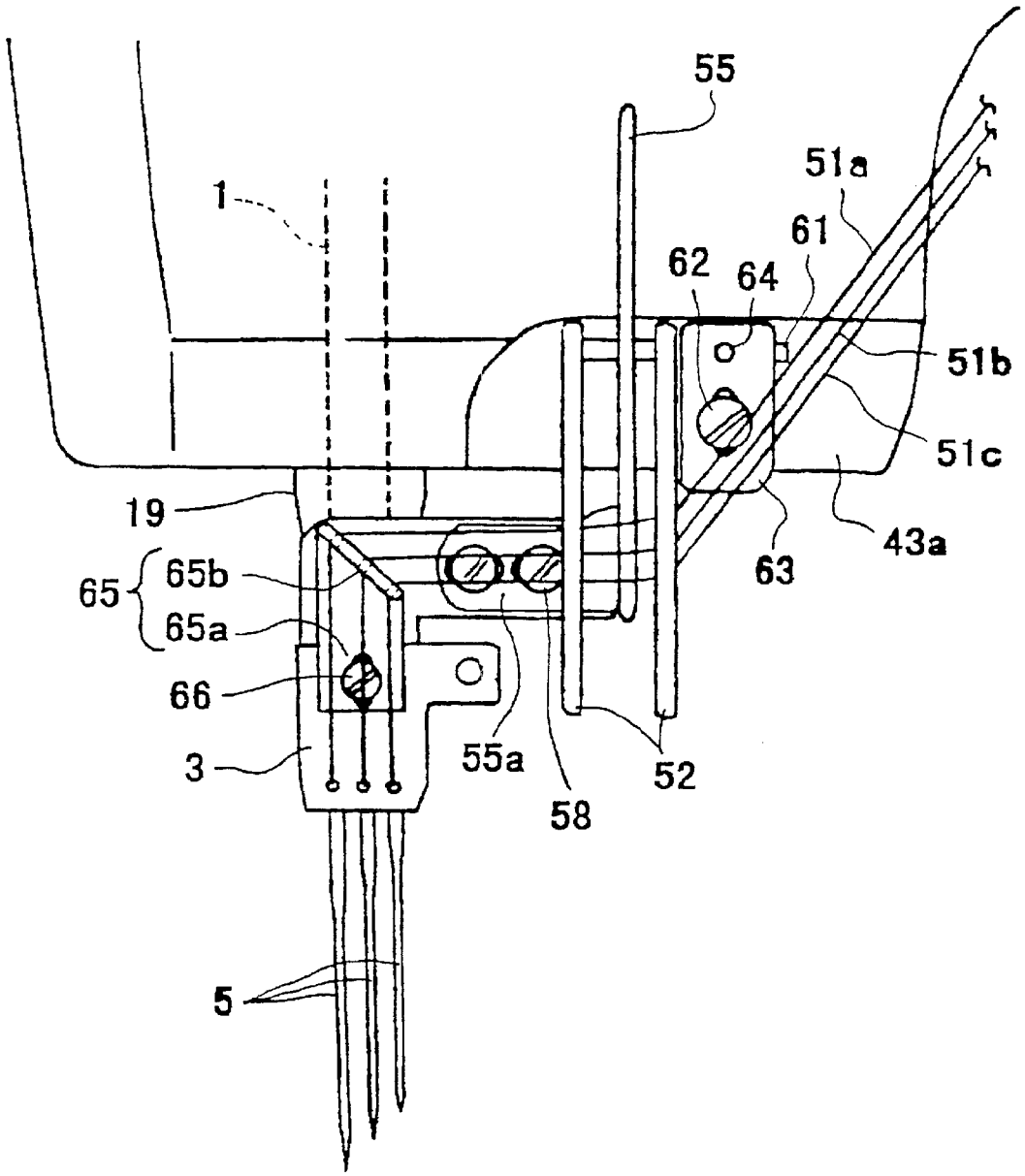
FIG. 5 is a magnified front view of the jaw of the sewing machine in FIG. 4.
Figure 7:
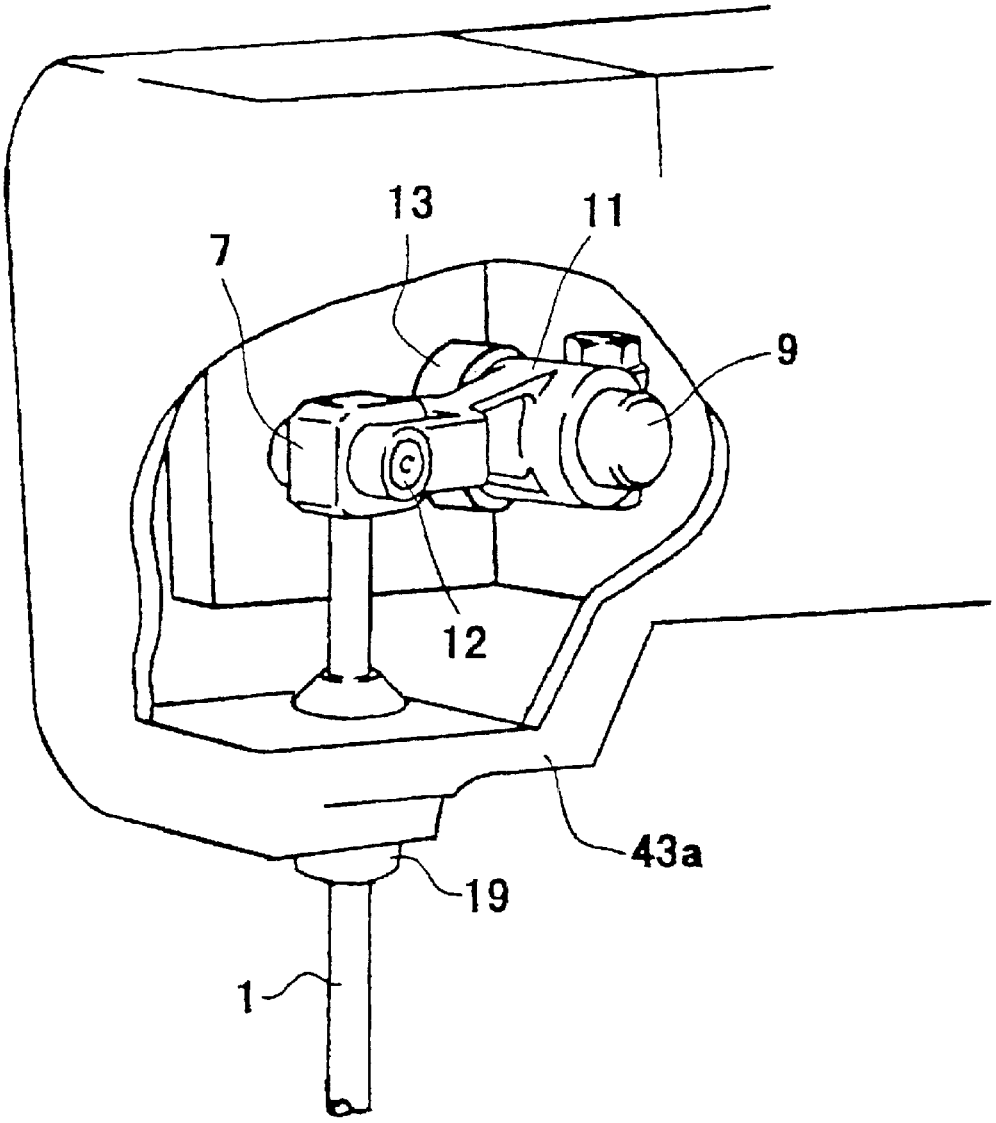
FIG. 7 is a perspective view showing essential parts of a needle bar mechanism.
Figure 8:
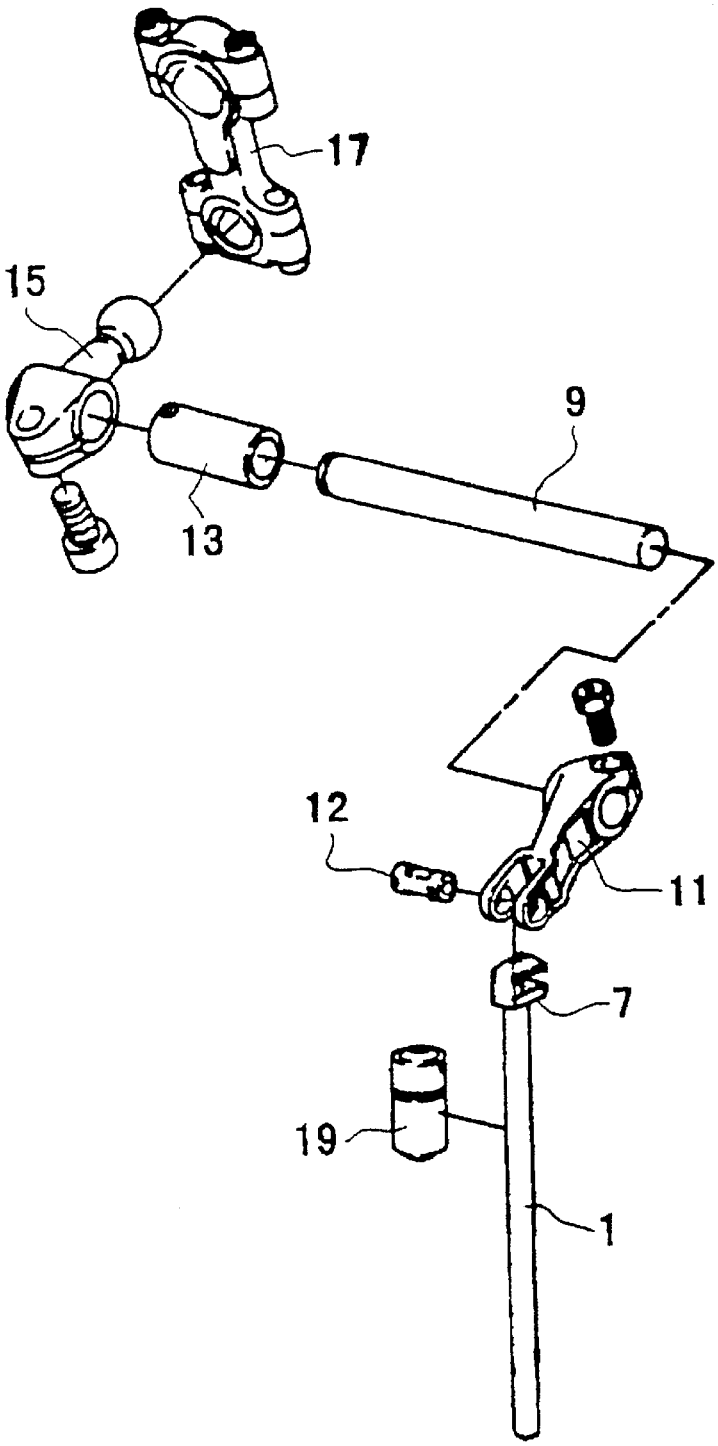
FIG. 8 is a perspective exploded view of the needle bar mechanism.

At the lower end of a needle bar 1 shown in FIG. 7 and FIG. 8, a needle 5 is provided through a needle holder 3 as shown in FIG. 2 and FIG. 5. A pi-shaped guide 7 formed at the upper end of the needle bar is coupled to a lever 11 through a pin 12, and the lever 11 is fixed to one end of an oscillating shaft 9 which oscillates in cooperation with the upper shaft not shown. The oscillating shaft 9 is orthogonal to the upper shaft, and is supported by a bearing 13 fixed to the sewing machine frame. A crank 15 fixed to other end of the oscillating shaft 9 is coupled to a rod 17 fitted to an eccentric cam (not shown) of the upper shaft, and when the upper shaft rotates, the lever 11 fixed to the oscillating shaft 9 oscillates vertically, thereby making the needle bar 1 supported by a bush 19 to move up and down. By vertical motion of the needle bar, the needle moves up and down by penetrating through a throat plate (not shown).

Looper Mechanism

Figure 9:
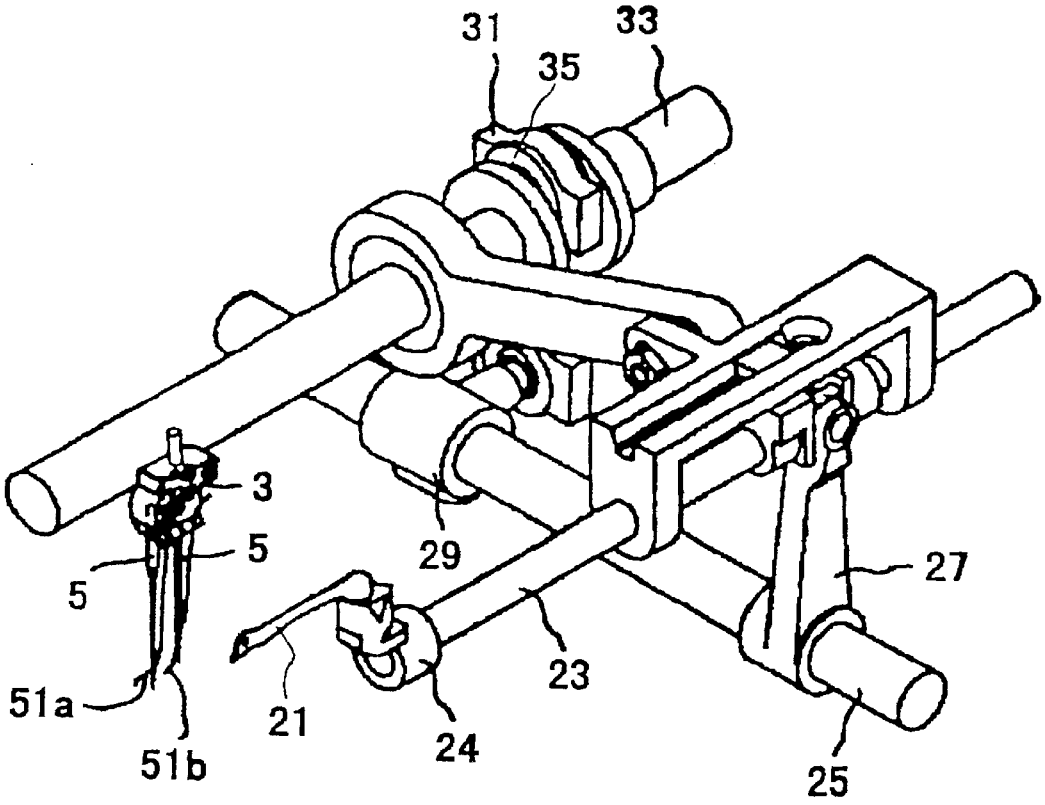
FIG. 9 is a perspective view of a looper mechanism.

As shown in FIG. 9, a looper 21 is mounted on a platform 24 fixed to a looper shaft 23. The looper shaft 23 is coupled to a leading end of a lever 27 fixed to an oscillating shaft 25. A crank 29 affixed to the oscillating shaft 25 is coupled to an eccentric cam 35 of a lower shaft 33 through a rod 31, and when the lower shaft 33 rotates, the oscillating shaft 25 oscillates, and the lever 27 swings right and left to move the looper shaft 23 reciprocally to right and left. By this reciprocal motion of the looper shaft 23, the looper 21 moves back and forth almost horizontally toward the needle 5.

Needle Thread Take-up Mechanism

Figure 1:
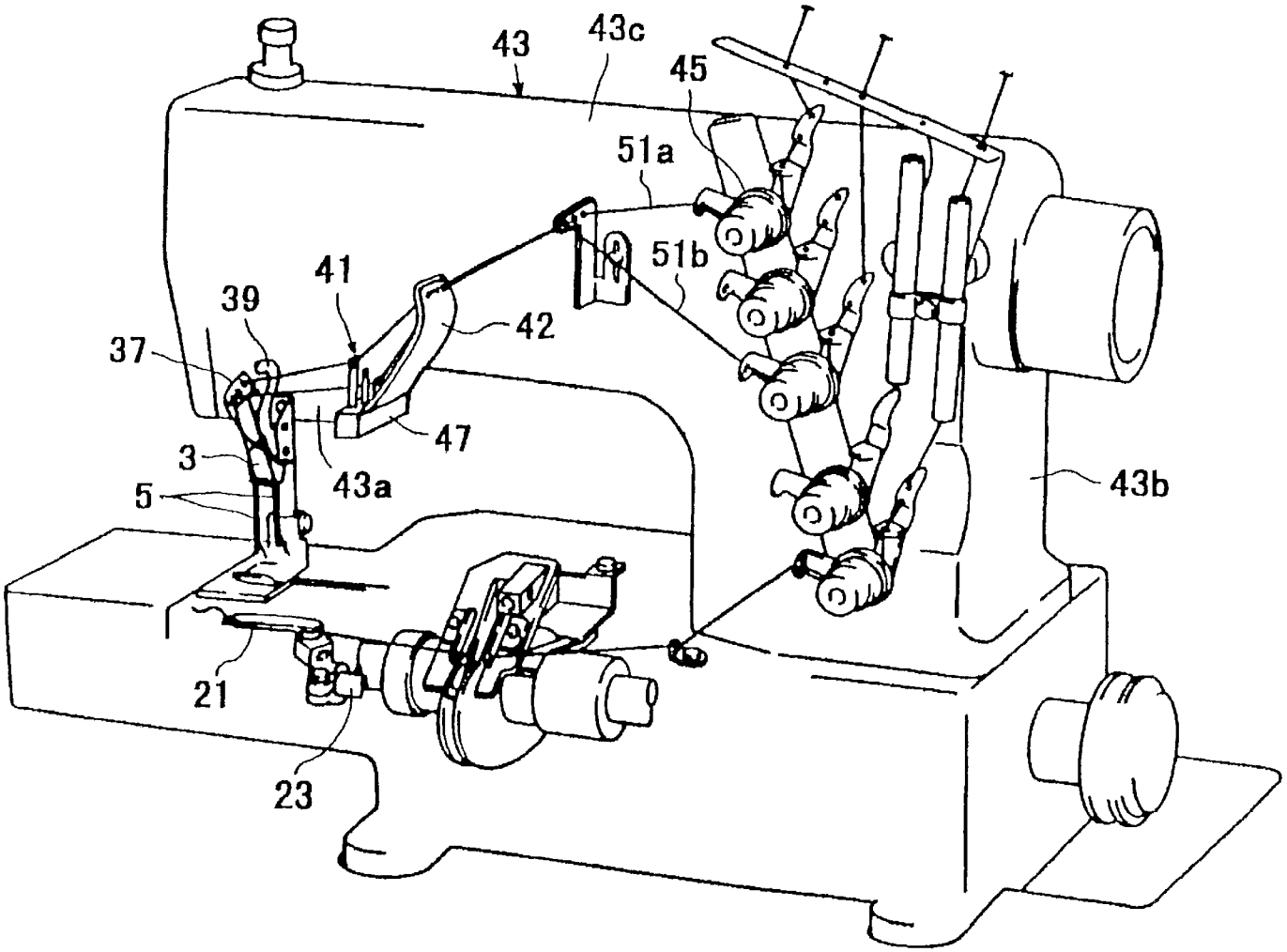
FIG. 1 is a perspective view showing an essential mechanism of a double chainstitch sewing machine of the present invention.
Figure 3:
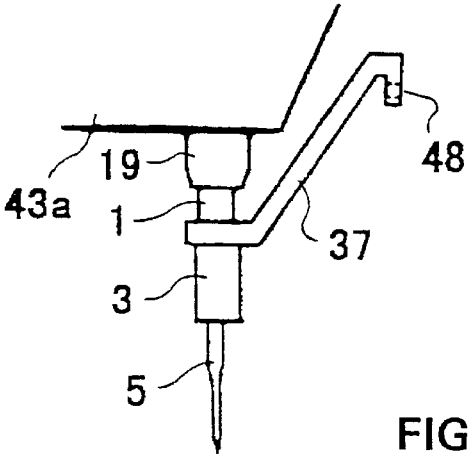
FIG. 3 is a side view thereof.

The needle thread take-up mechanism controls take-up of needle threads 51*a*, 51*b* from a thread tension device 45 to the needle 5, and comprises a movable thread guide 37, a thread take-up cam 39, fixed thread guide 41, and others as shown in FIG. 1 and FIG. 2. The movable thread guide 37 is fixed to the needle bar 1 on the needle holder 3 as shown in FIG. 3, and has thread eyes 48 for passing the needle threads 51*a,* 51*b* in oblique upward arrangement. The movable thread guide 37 moves up and down together with the needle bar 1, and takes up the needle threads 51*a,* 51*b* leaving the fixed thread guide 41 by swinging up and down.

The fixed thread guide 41 attached to the leading end of an L-shaped bracket 47 fitted to the outside of a jaw 43*a* of a sewing machine arm 43 by a screw 44 so that the lateral position may be adjustable, and is composed of three needle thread guide members 41*a,* 41*b,* 41*c* having thread eyes for guiding the needle threads 51*a,* 51*b,* 51*c* individually. These needle thread guide members 41*a,* 41*b,* 41*c* are fixed to the bracket 47 by screws (not shown) so that the vertical position may be adjustable individually, and the needle thread guide member closer to the needle bar 1 is set higher as shown in FIG. 2. The bracket 47 has a needle thread lead plate 42 for passing the needle threads 51*a,* 51*b* from the thread tension device 45 to the fixed thread guide 41.

The thread take-up cam 39 is attached to the portion folded forward at one end of a bracket 49 by a screw 51 so as to be adjustable in vertical position, and the bracket 49 is fixed to the outside of the jaw 43*a* of the sewing machine arm 43 by a screw 52 so as to be adjustable in lateral position.

This thread take-up cam 39 has a cam section intersecting with the thread pathway between the fixed thread guide 41 and movable thread guide 37, and extending in the vertical direction, and the cam section is engaged with the needle threads 51*a,* 51*b* between the fixed thread guide 41 and movable thread guide 37, and takes up the needle threads 51*a,* 51*b* from the workpiece to the thread tension device 45 by way of the thread guide members 37, 41, 42 together with the movable thread guide 37.

In the illustrated embodiment, the thread tension device 45 of the needle thread is provided at the front side of a base part 43*b* of the sewing machine arm 43, but it is not limited to this structure. For example, to shorten the thread pathway length ranging from the workpiece to the thread tension device 45 further, the thread tension device 45 may be disposed in a wider part 43*c* of the sewing machine arm 43, or may be set closer to the sewing portion of the workpiece.

A double chainstitch sewing machine in a second embodiment of the present invention comprises a needle bar mechanism, a looper mechanism, a needle thread take-up mechanism, and the needle bar mechanism and looper mechanism are same as in the double chainstitch sewing machine in the first embodiment.

Needle Thread Take-up Mechanism

The needle thread take-up mechanism differs from the needle thread take-up mechanism in the first embodiment in the following points.

Figure 4:
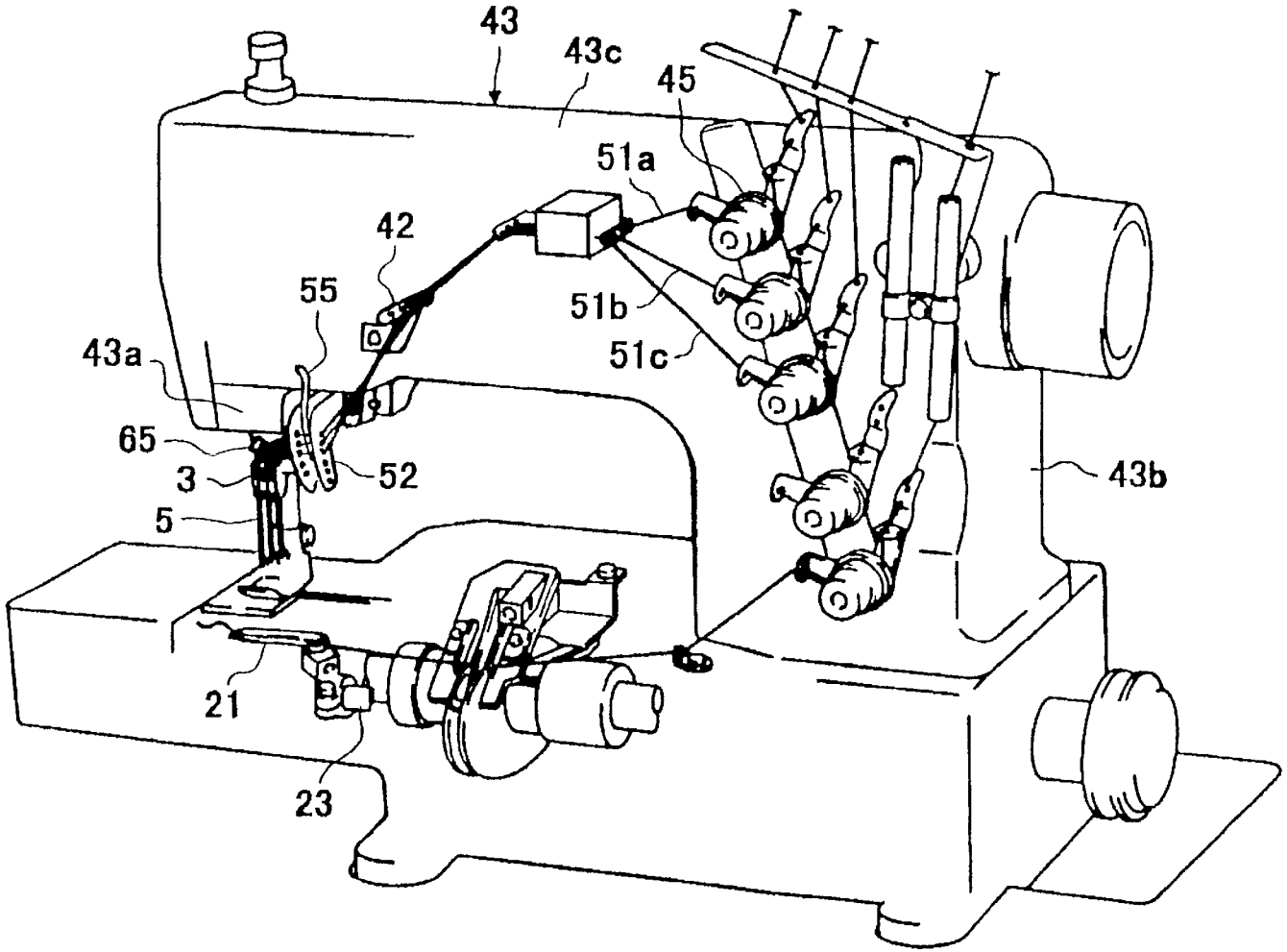
FIG. 4 is a perspective view showing an essential mechanism of other double chainstitch sewing machine of the present invention.

As shown in FIG. 4 and FIG. 5, a thread take-up cam 55 is supported by a needle bar 1. That is, a mounting part 55*a* of the thread take-up cam 55 is affixed to a bracket 57 fixed to a needle holder 3 by a screw 58 so as to be adjustable in lateral position, and the thread take-up cam 55 is supported by the needle bar 1, and it moves up and down together with the needle bar 1 unlike the first embodiment. A fixed thread guide 52 is composed of a pair of right and left plates, and a pin 61 for fitting a holder 63 is provided at its upper end. The fixed thread guide 52 is disposed at the right and left side of the thread take-up cam 55. The holder 63 is affixed to the outside of a jaw 43*a* of a sewing machine arm 43 by a screw 62 so as to be adjustable in vertical position. A pin 61 projecting to a side is supported by the holder 63 so as to be slidable laterally and rotatable, and is fixed to the holder 63 by a screw 64. The fixed thread guide 52 has mutually confronting right and left thread eyes.

The thread take-up cam 55 is engaged with needle threads 51*a,* 51*b,* 51*c* passed in the fixed thread guides 52 at both sides, and moves up and down together with the needle bar 1, thereby taking up the needle threads 51*a,* 51*b,* 51*c*. A movable thread guide 65 has a mounting part 65*a* affixed to the needle holder 3 by a screw 66 so as to be adjustable in vertical direction, and also has plural thread eyes 65*b* for passing the sewing threads 51*a,* 51*b,* 51*c*.

The movable thread guide 65 moves up and down together with the needle bar 1 same as in the first embodiment, and takes up the needle threads 51*a,* 51*b,* 51*c,* ranging from the work piece to the thread tension device 45 through the fixed thread guide 52.

A double chainstitch sewing machine in a third embodiment of the present invention is similar to the double chainstitch sewing machine in the first embodiment, except that the upper cover thread mechanism and upper cover thread take-up tool are further added.

The upper cover thread mechanism and upper cover thread take-up tool are described sequentially below.

Upper Cover Thread Mechanism

Figure 10:
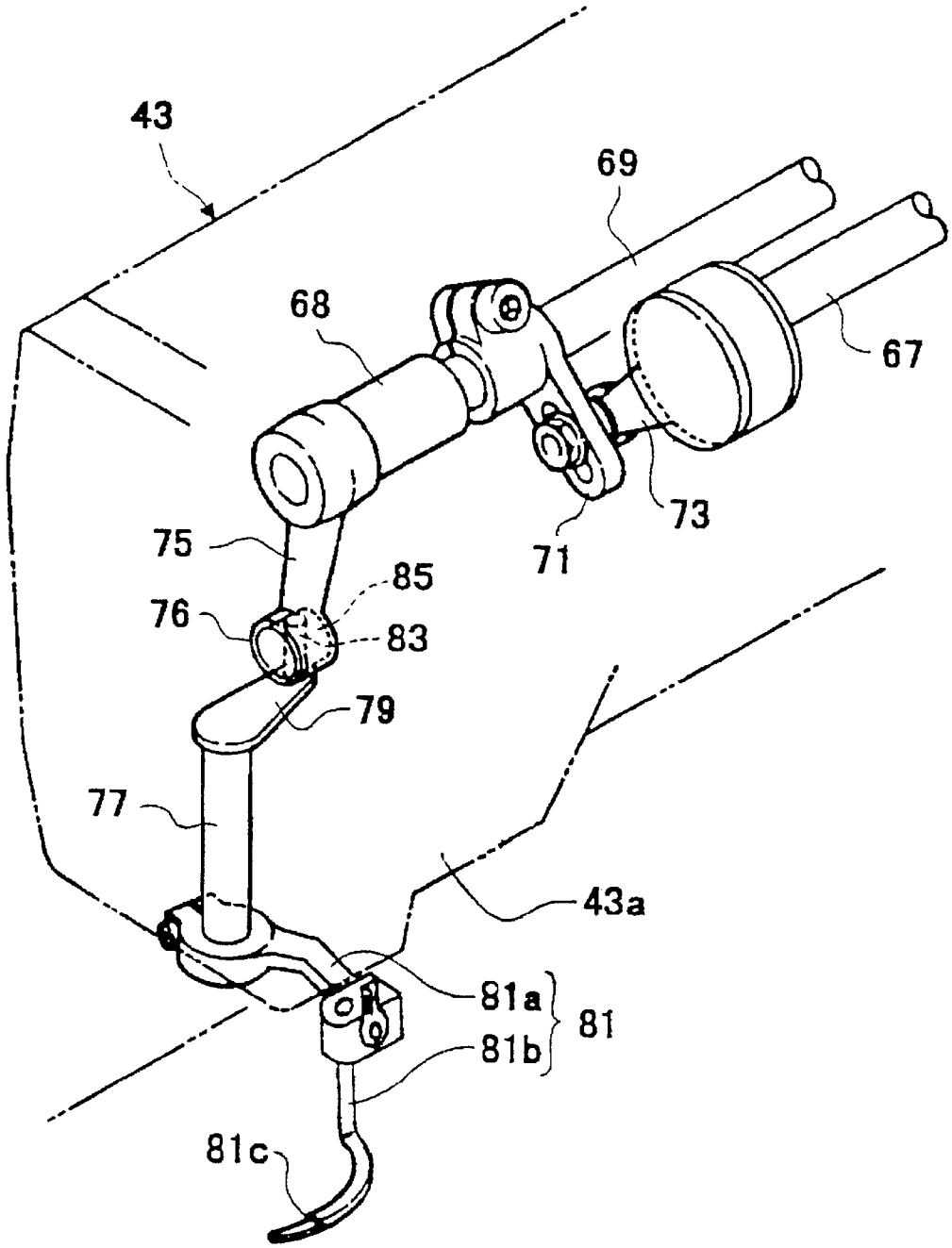
FIG. 10 is a perspective view of an upper cover thread mechanism.
Figure 11:
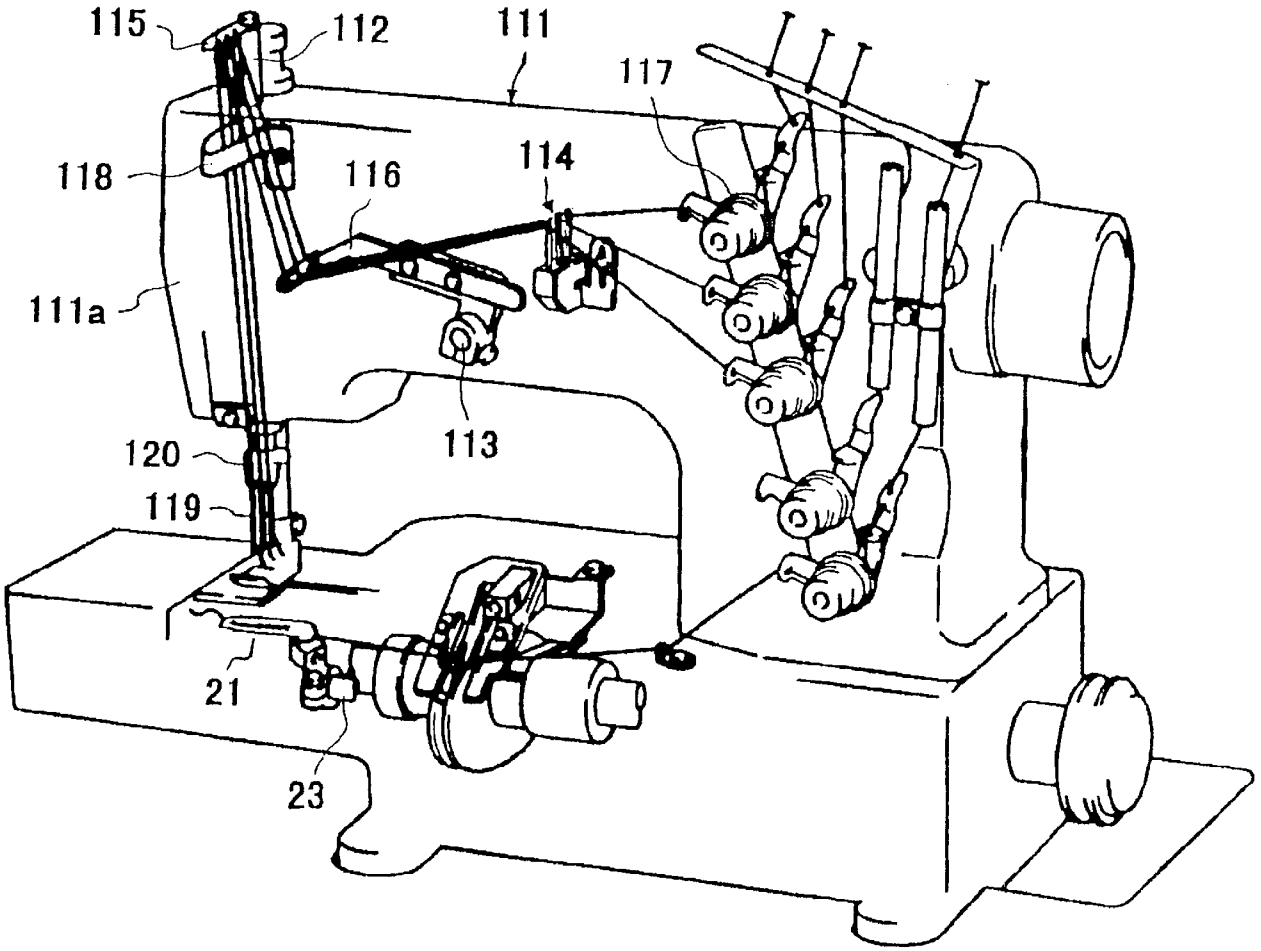
FIG. 11 (PRIOR ART)
FIG. 11 is a perspective view of a conventional double chainstitch sewing machine.

As shown in FIG. 10, an oscillating shaft 69 rotatably supported by a bushing 68 in a sewing machine arm 43 is provided parallel to an upper shaft 67. An oscillating lever 71 attached to the oscillating shaft 69 is coupled to the upper shaft 67 through a rod 73 fitted to an eccentric cam of the upper shaft 67, and by rotation of the upper shaft 67, the oscillating shaft 69 oscillates. A crank arm 75 is affixed to the leading end of the oscillating shaft 69. A longitudinal shaft 77 supported rotatably by the sewing machine arm 43 has a lever 79 at its upper end, and a spreader 81 is fixed to the lower end extended to the outside of the sewing machine arm 43. This spreader 81 is composed of a spreader holder 81a fixed to the lower end of the longitudinal shaft 77 and a spreader piece 81*b* fitted to the spreader holder 81*a*.

The leading end of the lever 79 of the longitudinal shaft 77 is provided a pin 83. The pin 83 is coupled to a cylindrical part 76 at the lower end of the crank arm 75 through a columnar peg 85. Accordingly, when the upper shaft 67 rotates, the oscillating shaft 69 oscllates and the crank arm 75 oscillates back and forth, so that the longitudinal shaft 77 oscillates rotatably through the columnar peg 85 and the pin 83. By rotatable oscillation of the longitudinal shaft 77, the spreader piece 81*b* of the spreader 81 oscillates as with swinging right and left.

Upper Cover Thread Take-up Mechanism

Figure 6:
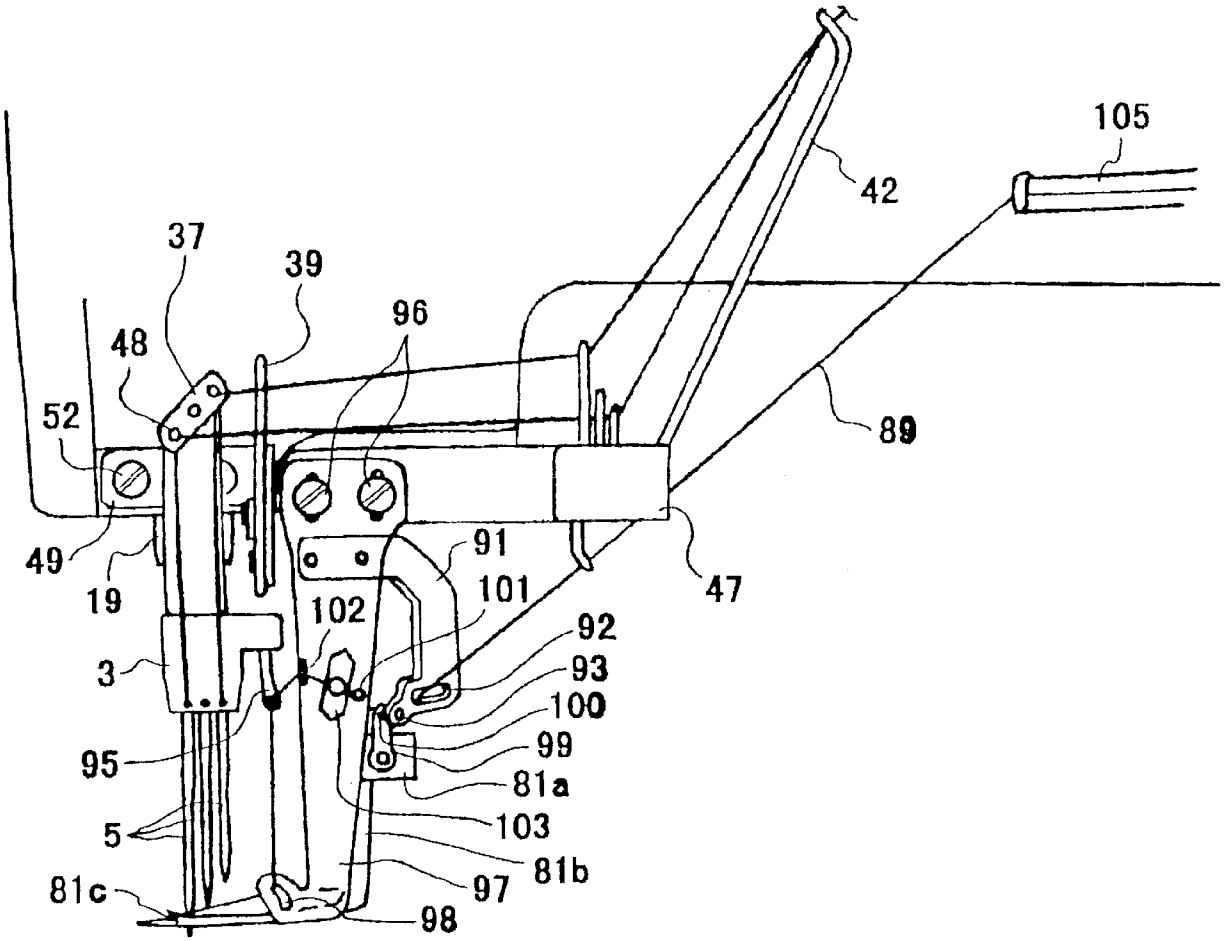
FIG. 6 is a magnified front view of the jaw of the sewing machine in FIG. 2 further provided with an upper cover thread take-up mechanism.

As shown in FIG. 6, a fixed thread guide 91 is provided in the jaw 43*a* of the sewing machine arm 43. The fixed thread guide 91 has a long thread eye 92 and a round thread eye 93 for passing the upper cover thread 89 passing from a thread tension device (not shown) through a thread lead piece 105. The needle holder 3 has a thread lead tool 95 having a thread eye 94 for passing the upper cover thread 89.

A thread swing guide 97 affixed to the outside of the jaw 43*a* of the sewing machine arm 43 by a screw 96 so as to be adjustable in vertical direction has a first thread eye 101 and a second thread eye 102 for passing the upper cover thread 89 from a cover thread take-up tool 99 to the thread lead tool 95. A small tension device 103 is provided in the thread pathway between the two thread eyes 101, 102. The upper cover thread 89 positioned between the both thread eyes is pressed to the front side of the thread swing guide 97 by means of the small tension device 103.

An arc-shaped slot 98 is provided at the leading end of the thread swing guide 97. The upper cover thread 89 from the thread lead tool 95 to the spreader 81 is passed into the arc-shaped slot 98. The cover thread take-up tool 99 is provided in the spreader holder 81*a* attached to the lower end of the longitudinal shaft 77 shown in FIG. 10. This cover thread take-up tool 99 has a thread eye 100 for passing the upper cover thread 89 from the fixed thread guide 91 to the first thread eye 101 of the thread swing guide 97.

As shown in FIG. 6, the upper cover thread 89 is passed into the long thread eye 92 or round thread eye 93 of the fixed thread guide 91 from the thread tension device (not shown) to the thread lead piece 105, and runs through the small tension device 103 by way of the thread eye 100 of the cover thread take-up tool 99 and the first thread eye 101 of the thread swing guide 97. The upper cover thread 89 running through the small tension device 103 is engaged with the hook let 81*c* of the spreader piece 81*b* by way of the second thread eye 102, thread eye 94 of the thread lead tool 95, and slot 98 of the thread swing guide 97.

While the sewing machine is running, the upper cover thread 89 is mainly taken up by the cover thread take-up tool 99, and the thread take-up amount varies depending on the difference of passing into the long thread eye 92 and round thread eye 93 formed in the fixed thread guide 91. This difference corresponds to the type of thread, for example, the cotton thread corresponds to the long thread eye 92, and the woolly thread to the round thread eye 93.

The cover thread take-up tool 99 is preferred to be designed so that the distance to the longitudinal shaft 77 of the upper cover thread mechanism may be variable. The thread tension device for the upper cover thread is not described in detail, but its position is preferred to be closer to the sewing part, such as the wide part 43*c* of the sewing machine arm 43, in order to shorten the thread pathway length of the upper cover thread.

What is claimed is:

1. A double chainstitch sewing machine for forming a double chainstitch in a workpiece supplied onto a throat plate, comprising a needle bar moving vertically through a needle bar drive mechanism by rotation of an upper shaft, at least one needle attached to the lower end of the needle bar through a needle holder for moving vertically through the throat plate, a looper moving back and forth laterally toward the needle in cooperation with the rotation of a lower shaft, and a plurality of thread tension devices for adjusting the tension of the needle thread and looper thread threading in the needle and looper respectively, characterized in that said sewing machine further comprises a fixed thread guide fixed to a jaw of a sewing machine arm for leading a needle thread, a movable thread guide fixed at the lower end of the needle bar and having a thread eye for passing the needle thread, and a thread take-up cam fixed to the jaw of the sewing machine arm and having a cam section extended in a vertical direction by intersecting with the needle thread pathway between said fixed thread guide and movable thread guide, wherein the needle thread from the fixed thread guide to the movable thread guide is engaged with the cam section of the thread take-up cam by moving up and down by vertical motion of the movable thread guide accompanying the vertical motion of the needle bar, and the needle thread is taken up from the thread tension device to the needle by the interaction of the movable thread guide and the cam section of the thread take-up cam.

2. A double chainstitch sewing machine for forming a double chainstitch in a workpiece supplied onto a throat plate, comprising a needle bar moving vertically through a needle bar drive mechanism by rotation of an upper shaft, at least one needle attached to the lower end of the needle bar through a needle holder for moving vertically through the throat plate, a looper moving back and forth laterally toward the needle in cooperation with the rotation of a lower shaft, and a plurality of thread tension devices for adjusting the tension of the needle thread and looper thread penetrating through the needle and looper respectively, characterized in that said sewing machine further comprises a fixed thread guide fixed to a jaw of a sewing machine arm and having right and left thread eyes disposed oppositely to each other, a movable thread guide fixed at the lower end of the needle bar and having a thread eye for passing the needle thread, and a thread take-up cam fixed to the lower end of the needle bar and having a cam section disposed between the thread eyes of the fixed thread guide, wherein the needle thread from the fixed thread guide to the movable thread guide is oscillated up and down by vertical motion of the movable thread guide accompanying the vertical motion of the needle bar, and the needle thread between the thread eyes of the fixed thread guide is inflected by vertical motion of the thread take-up cam accompanying the vertical motion of the needle bar, and the needle thread is taken up from the thread tension device to the needle by the interaction of these motions.

3. The double chainstitch sewing machine according to claim 1, wherein two or more thread eyes of the movable thread guide are provided, and the thread eyes are arranged and set in an oblique direction to the motion direction of the needle bar.

4. The double chainstitch sewing machine according to claim 1, wherein two or more thread eyes of the movable thread guide are provided, the fixed thread guide is composed of a plurality of needle thread guide members, and each needle thread guide member is capable of adjusting the leading position of the needle thread individually.

5. The double chainstitch sewing machine according to claim 1, wherein said double chainstitch sewing machine further comprises an upper cover thread mechanism including a thread tension device for adjusting the thread tension of the upper cover thread at the front side of the sewing machine, a fixed thread guide fixed to the jaw of the sewing machine arm for leading the upper cover thread, a spreader for swinging the upper cover thread laterally to be engaged with the needle thread, a thread lead tool attached to the needle holder for swinging and leading the upper cover thread, and a thread swing guide fixed to the jaw of the sewing machine arm, said thread swing guide having a thread eye for leading the upper cover thread from the fixed thread guide to the thread lead tool, and a slot for leading the upper cover thread from the thread lead tool to the spreader, and said upper cover thread mechanism has a cover thread take-up tool attached to the spreader, and takes up the upper cover thread by engaging with the upper cover thread from the fixed thread guide to the thread swing guide.

6. The double chainstitch sewing machine according to claim 1, wherein the upper end of the needle bar is included in a sewing machine frame.

7. The double chainstitch sewing machine according to claim 6, wherein the needle bar drive mechanism includes an oscillating shaft orthogonal to the upper shaft for oscillating in cooperation with the rotation of the upper shaft, and a lever fixed to the oscillating shaft for driving the needle bar and being coupled to the upper end of the needle bar.

* * * * *